US005213150A

United States Patent [19]

Sensenstein

[11] Patent Number: 5,213,150

[45] Date of Patent: May 25, 1993

[54] CORE KNOCK-OUT FIXTURE

[75] Inventor: Jakob H. Sensenstein, Toledo, Ohio

[73] Assignee: Doehler-Jarvis Limited Partnership, Toledo, Ohio

[21] Appl. No.: 681,312

[22] Filed: Apr. 8, 1991

[30] Foreign Application Priority Data

Nov. 7, 1990 [JP] Japan ..... 2-300029

[51] Int. Cl.[5] ..... B22D 29/00

[52] U.S. Cl. ..... 164/404; 164/345

[58] Field of Search ..... 164/404, 401, 344, 345, 164/131, 132

[56] References Cited

U.S. PATENT DOCUMENTS

| | | | |
|---|---|---|---|
| 3,162,910 | 12/1964 | Behnke et al. | 164/401 X |
| 4,185,681 | 1/1980 | Church et al. | 164/404 X |
| 4,206,800 | 6/1980 | Pol | 164/401 |
| 4,206,801 | 6/1980 | Clarke | 164/401 |
| 4,577,671 | 3/1986 | Stephan | 164/401 |
| 4,643,243 | 2/1987 | McKibben et al. | 164/404 X |
| 4,662,425 | 5/1987 | Musschoot et al. | 164/404 X |
| 4,722,386 | 2/1988 | Casey | 164/404 |

FOREIGN PATENT DOCUMENTS

| | | | |
|---|---|---|---|
| 3637367 | 6/1987 | Fed. Rep. of Germany | 164/404 |
| 50-19494 | 7/1975 | Japan | 164/401 |
| 997976 | 2/1983 | U.S.S.R. | 164/401 |
| 2074911A | 11/1981 | United Kingdom | 164/344 |

*Primary Examiner*—J. Reed Batten, Jr.
*Attorney, Agent, or Firm*—Hugh Adam Kirk

[57] ABSTRACT

The special angular fixture or jig for mounting a casting, such as a die cast engine block, resiliently holds the casting both inside and outside of a cabinet, in which cabinet the casting is high-frequency-vibrated for removing an expendable and disintegrated core, such as of sand, from the casting. The fixture is so located with respect to the door to the cabinet so that when the door is closed, the casting on the fixture is resiliently held between the closed door and a vibrating plate of a high-frequency vibrator. Specifically, the fixture disclosure is L-shaped and mounted on cushioned legs to a downwardly open door to a cabinet, which legs permit the casting to be urged against a vibrating plate mounted in the cabinet when the door of the cabinet is closed. The cabinet collects the particles of the disintegrated core which are vibrated from the casting.

11 Claims, 3 Drawing Sheets

CORE KNOCK-OUT FIXTURE

BACKGROUND OF THE INVENTION

Cabinets with high-frequency vibrators for removing particles from objects are well known. However, applicant has no knowledge of a jig for supporting die cast engine blocks with coated sand cores in relatively large die castings which require not only special support, but also particular parts against which vibrators can be placed and urged in order to effectively remove the disintegrated cores.

SUMMARY OF THE INVENTION

Generally speaking, this invention deals with a specific L-shaped type fixture or jig for mounting a casting, such as an engine block, after it has been cast, including die cast, and before the sand cores therein have been removed. This jig is resiliently held against a high-frequency vibrator, such as pneumatic, hydraulic, sonic or the like vibrator, in a cabinet for effectively removing all sand particles from such castings. If this sand were not all removed, it would cause difficulties in the machining, the assembly, and the operation of the machines of which these castings are a part.

More specifically, the fixture for these castings comprises a platform and side plate at an angle thereto, which fixture is resiliently mounted in a cabinet, such as on the inside of a door of a cabinet. In this cabinet is also located a high-frequency (HF) vibrator. The resilient mounting for this fixture may comprise hydraulic or pneumatic cushions in which the pressure of the air may be varied, or springs or resilient rubber legs which, when the door is closed, continuously urge the casting mounted on the jig against the vibrating plate of the vibrator. The jig is provided with means for fitting the particular casting to be place thereon, including being adapted for two, four or V8 cylinder engine blocks. The angular walls of the fixture, when mounted on a hinged door to a cabinet, act as supports for the casting when the door is closed, as well as when the door is open. After the door is closed, the vibrator is operated for a predetermined time, and then stopped for a time sufficient for the shaken-out particles to settle before the door is opened and the cleaned casting is removed. The cabinet also is provided with a collector for the sand particles.

OBJECTS AND ADVANTAGES

Accordingly, it is an object of this invention to produce a simple, efficient, effective, economic and simple jig for supporting castings in a cabinet against a high-frequency vibrator for removing the disintegrated sand cores from the cavities and ducts in castings.

Another object is to produce such a fixture which places a relatively strong part of a casting against a vibrating plate and resiliently hold it against that plate so as to prevent the casting per se from being mutilated by the vibrations.

BRIEF DESCRIPTION OF THE VIEWS

DETAILED DESCRIPTION OF THE VIEWS

Figure 1:
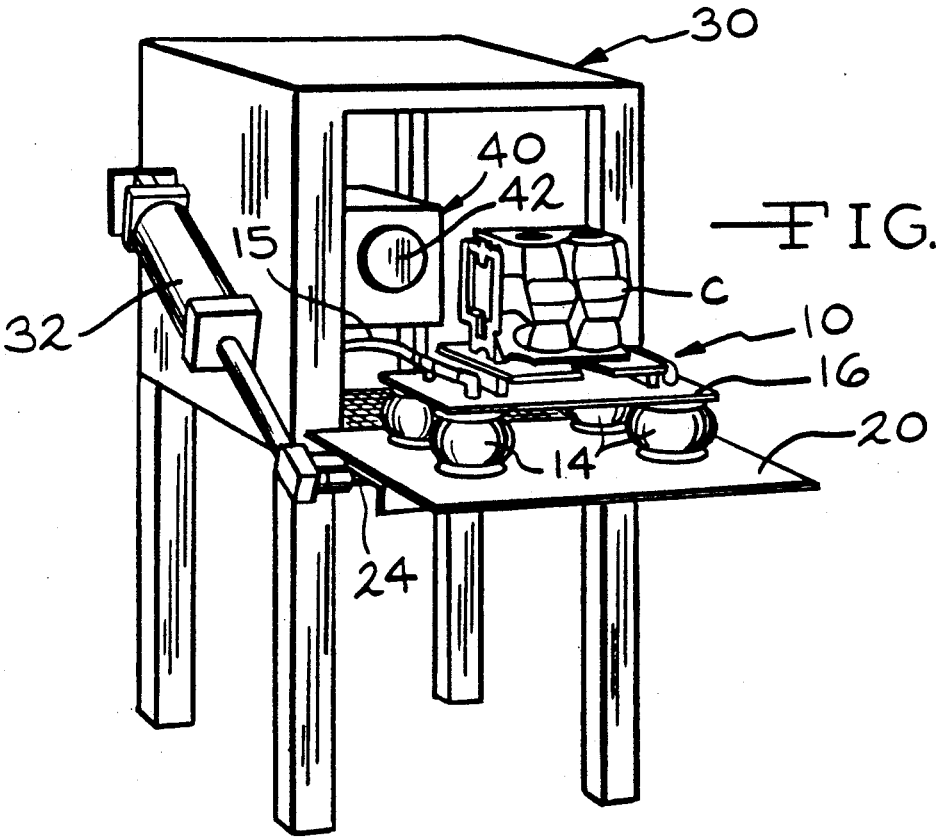
FIG. 1 is a perspective view of a cabinet having a vibrator therein and a downwardly open door upon which a resiliently mounted fixture according to a preferred embodiment of this invention is supporting a two-cylinder die cast engine block.
Figure 3:
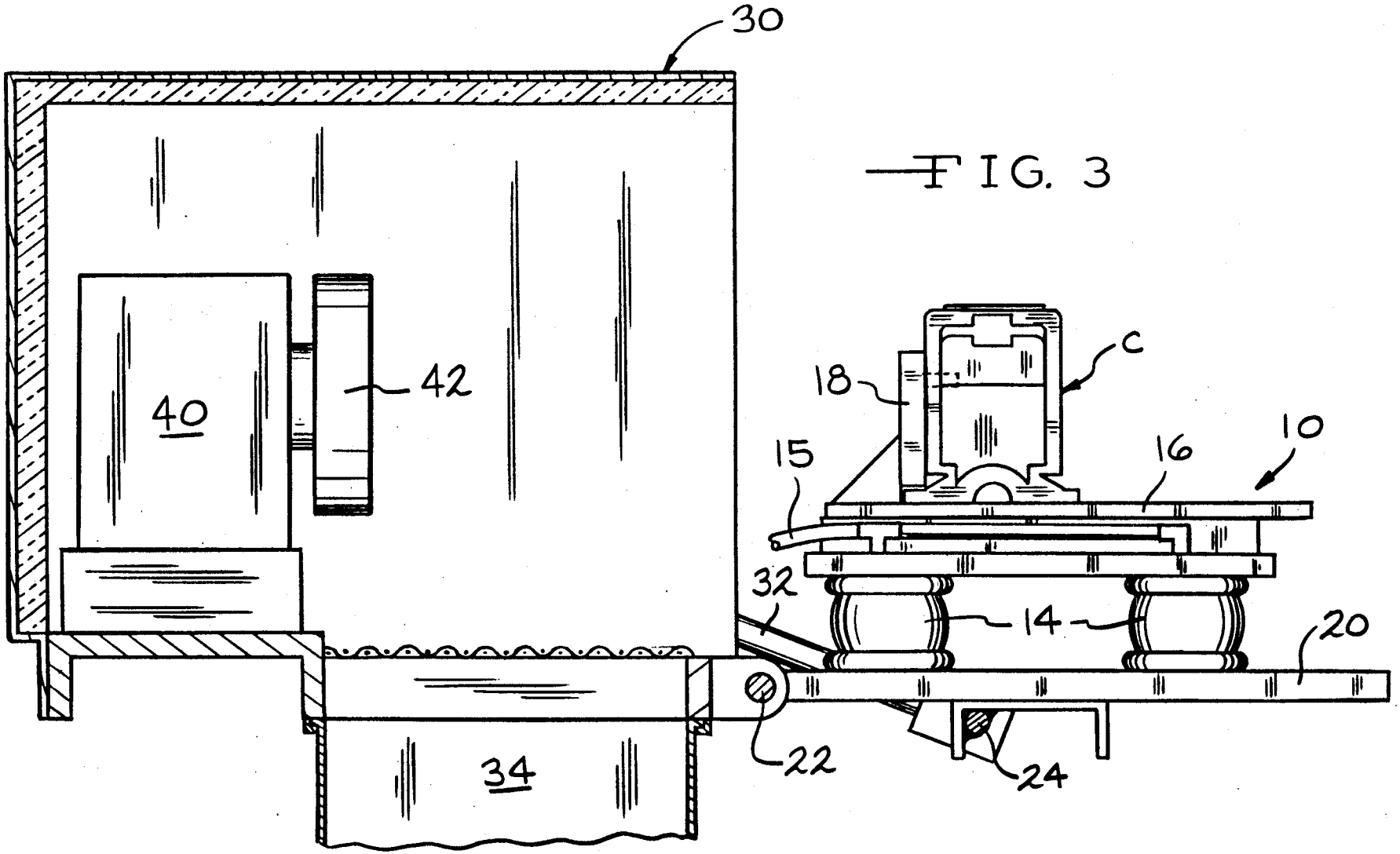
FIG. 3 is an enlarged vertical sectional view of the cabinet shown in FIG. 1.
Figure 4:
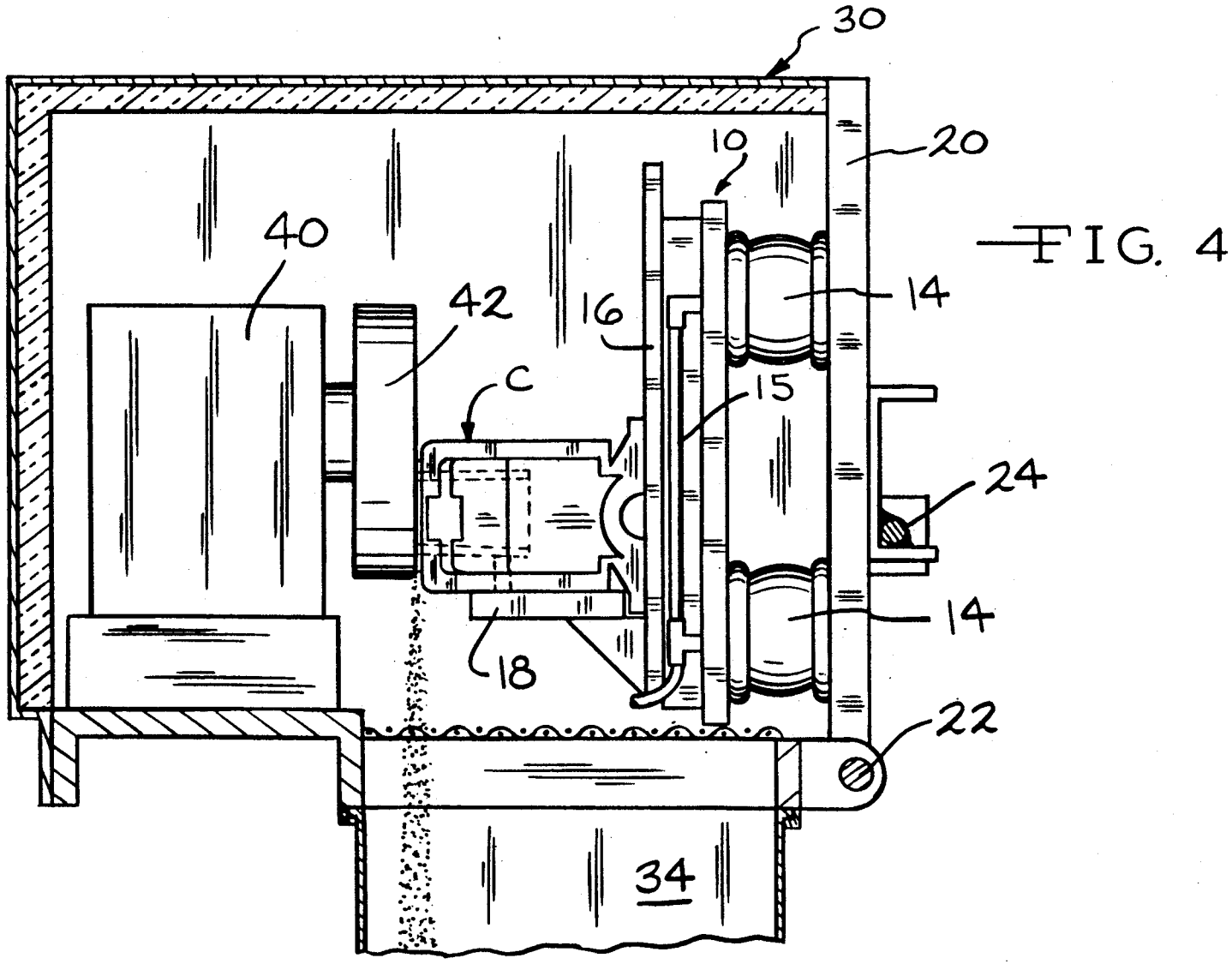
FIG. 4 is a view similar to FIG. 3, but with the door shut and the resilient mounting of the fixture urging the head of the engine block casting against the vibrating plate of the vibrator in the cabinet.

In FIG. 1 there is shown a resiliently mounted jig or fixture 10 mounted on the downwardly open door 20 hinged at 22 to a bottom front wall of a cabinet 30. Adjacent the back wall of this cabinet is mounted a pneumatic high-frequency vibrator 40 having a vibrating plate 42. On each side of the cabinet 30 is mounted a hydraulic cylinder and piston 32, which is connected to the outside of the door 20 by a pivot 24, for closing the door 20 from the open position shown in FIGS. 1 and 3 to the closed position shown in FIG. 4 and vice versa. A receptacle 34 is shown under the cabinet 30 in FIGS. 3 and 4 for collecting the sand that is vibrated out of the casting C when the door 20 is closed and the die casting C has its upper open cylinder end continuously urged against the vibrating plate 42 as shown in FIG. 4.

Figure 2:
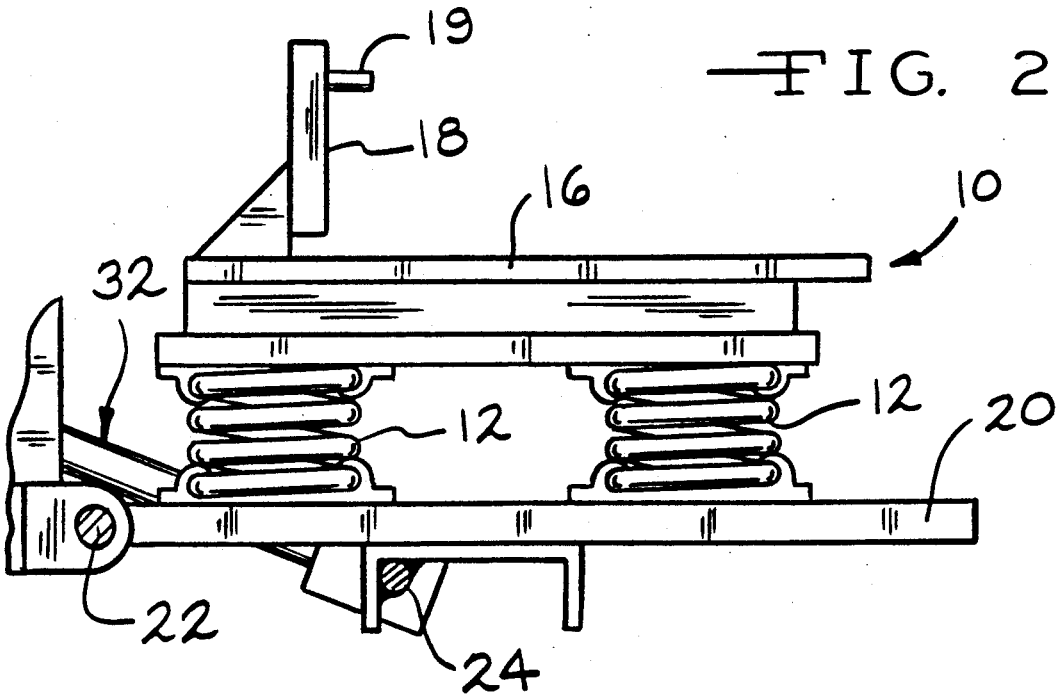
FIG. 2 is an enlarged view of the side of the open door and of the fixture shown in FIG. 1 showing another embodiment of the resilient mounting for the fixture.

Referring now more specifically to the fixture 10 of L-shaped contour and mounted on the resilient legs 12 or 14, the legs 12 shown in FIG. 2 comprise helical compression springs while in the other views the resilient legs 14 comprise pneumatic cushions, the pressure in which may be controlled by the flexible hose connections 15. The platform base 16 of this fixture, which is mounted on the legs 12 or 14, is provided with an orthogonal or back plate 18 which supports the casting when it is moved at right angles from that shown in FIG. 3 to that shown in FIG. 4. This back plate 18 may be provided with pin means such as 19 for fitting the particular casting that is to have it sand core removed. The resilient mounting 12 or 14 and the platform 16 is so proportioned that when the door 20 of the cabinet 30 is shut, the casting will be firmly urged against the vibrating plate 42 so that the vibrator 40 will vibrate the casting C at a high frequency but not hammer the casting to deform it.

It is to be understood that the operation of this device may be manual or automatic and controlled by a timed program. Furthermore, it is to be understood that the fixture's legs 12 or 14 may be replaced by other types of resilient devices to perform the function required. Also the shape of the plate 42, platform 16, and its backing plate 18 may have different configurations for fitting different castings without departing from the scope of the invention.

Furthermore, it should be understood that the door of the cabinet may be hinged to a side or top rather than the bottom of the opening thereto, and the L-shaped fixture for the casting may be at another angle and/or for fitting the contour of a casting that may not have a pair of adjacent orthogonal sides. Furthermore, the vibrator may be mounted on the door and the jig or fixture mounted in a cabinet without departing from the scope of this invention.

Although a die cast aluminum two-cylinder engine block is shown in the drawings, it is to be clearly understood that castings of other materials, metals, and of other parts which have expendable cores, whether die cast or gravity cast, may have their disintegrated, disposable, or expendable cores removed by the apparatus of this invention. Still further, the vibrator employed may be powered by air, liquid, or electricity.

While there is described above the principles of this invention in connection with specific apparatus, it is to be clearly understood that this description is made only by way of example and not a limitation to the scope of this invention.

I claim:

1. A cabinet for removing particles from a disintegrated sand core in a casting, said cabinet comprising:

A) a hinged door movable from an open position to a closed position, and vice versa, B) a platform mounted on resilient legs on said door for supporting said casting, C) a back rigidly mounted on said platform adjacent the hinge of said door for supporting said casting when said door is in its closed position, and D) vibrating means in said cabinet for jarring said casting when said door is closed, and said resilient legs are urging said casting into contact with said vibrating means.

2. A cabinet according to claim 1 including receptacle means for collecting the particles removed from said casting during the vibrating thereof.

3. A cabinet according to claim 1 including hydraulic means for opening and closing said door.

4. A core removal device comprising:

A) a cabinet with a door;

B) a fixture mounted on resilient means on the inside of said door for holding a casting with a disintegrated sand cord in said casting, and C) a vibrator inside said cabinet opposite said resilient means of said fixture when said door is closed, whereby said resilient means of said fixture urges said casting against said vibrator for shaking out said disintegrated sand cord from said casting.

5. A device according to claim 4 wherein said resilient means are hydraulic cushions.

6. A device according to claim 4 wherein said resilient means comprise springs.

7. A device according to claim 4 wherein said door includes a hydraulic cylinder for opening and closing said door.

8. A device according to claim 4 wherein said vibrator comprises a casting-engaging plate vibrated by a high-frequency vibrator.

9. A device according to claim 4 wherein said fixture has adjacent angular sides for supporting a casting in both a position for mounting the casting and a position for vibrating the casting.

10. A device according to claim 9 wherein said sides are orthogonal to each other.

11. A device according to claim 4 wherein said door is a downwardly opening door.

* * * * *

UNITED STATES PATENT AND TRADEMARK OFFICE

CERTIFICATE OF CORRECTION

PATENT NO. : 5,213,150

DATED : May 25, 1993

INVENTOR(S) : Jakob H. Sensenstein

It is certified that error appears in the above-identified patent and that said Letters Patent is hereby corrected as shown below:

Column 1, line 37, change "place" to - - placed - - .

Column 2, line 39, change "it" to - - its - - .

Column 4, line 5, change "cord" to - - core - - .

Column 4, line 10, change "cord" to - - core - - .

Signed and Sealed this

Eleventh Day of January, 1994

Bruce Lehman

*Attest:*

BRUCE LEHMAN

*Attesting Officer*

*Commissioner of Patents and Trademarks*